US010906732B2

(12) United States Patent
Thiessen

(10) Patent No.: US 10,906,732 B2
(45) Date of Patent: Feb. 2, 2021

(54) MODULAR STORAGE TANK WITH SECONDARY CONTAINMENT

(71) Applicant: Westcap AG Corp., Grande Prairie (CA)

(72) Inventor: Lonny James Thiessen, Rocky View County (CA)

(73) Assignee: Westcap AG Corp., Winkler (CA)

( * ) Notice: Subject to any disclaimer, the term of this patent is extended or adjusted under 35 U.S.C. 154(b) by 44 days.

(21) Appl. No.: 16/509,837

(22) Filed: Jul. 12, 2019

(65) Prior Publication Data

US 2020/0017289 A1 Jan. 16, 2020

Related U.S. Application Data

(60) Provisional application No. 62/697,688, filed on Jul. 13, 2018.

(51) Int. Cl.
*B65D 88/00* (2006.01)
*B65D 88/08* (2006.01)
*B65D 90/04* (2006.01)

(52) U.S. Cl.
CPC ..... *B65D 88/005* (2013.01); *B65D 88/08* (2013.01); *B65D 90/046* (2013.01)

(58) Field of Classification Search
CPC ..... B65D 88/005; B65D 88/00; B65D 88/08; B65D 90/046; B65D 90/04
USPC ..... 220/567, 565, 9.1
See application file for complete search history.

(56) References Cited

U.S. PATENT DOCUMENTS 2,912,137 A * 11/1959 Taylor ..... B65D 90/046 220/23.87
3,409,916 A * 11/1968 Billig ..... E04H 4/0018 52/146
5,558,245 A * 9/1996 White ..... B65D 90/046 137/343
2018/0208393 A1* 7/2018 Claeys ..... B65D 90/205

FOREIGN PATENT DOCUMENTS

FR 1188221 A * 9/1959 ..... B65D 88/52

OTHER PUBLICATIONS

Translation of FR 1188221, Friedrichs, Sep. 21, 1959, Fig. 1 (Year: 1959).*

* cited by examiner

*Primary Examiner* — Robert J Hicks
(74) *Attorney, Agent, or Firm* — Ryan W. Dupuis; Ade & Company Inc; Michael R. Williams

(57) ABSTRACT

A modular storage tank has a secondary containment receptacle defined by a plurality of rigid floor panels which are joined to one another to form a continuous floor and a plurality of rigid, upright wall panels joined to one another to form a continuous perimeter wall extending upwardly from the continuous floor, and a primary containment receptacle defined by a flexible line membrane within the secondary containment receptacle. The wall panels are joined to one another using a gasket and threaded fasteners such that the wall panels are readily separable from one another for reuse at different site after disassembly. The floor panels are joined to one another and to the perimeter wall by welded seams.

16 Claims, 8 Drawing Sheets

MODULAR STORAGE TANK WITH SECONDARY CONTAINMENT

This application claims the benefit under 35 U.S.C. 119(e) of U.S. provisional application Ser. No. 62/697,688, filed Jul. 13, 2018.

FIELD OF THE INVENTION

The present invention relates to modular tanks assembled from a plurality of floor and/or wall panels, and more particularly the present invention relates to a modular tank providing a primary containment vessel together with secondary containment.

BACKGROUND

Within the oil and gas drilling industry, fracing is becoming the most common method to complete and produce hydrocarbons from a wellbore. Fracing is a method where fluid, normally consisting of water, containing sand (or other proppants) and other chemicals is pumped at high pressure down the wellbore to force open fissures to extract hydrocarbons. As the wellbores are being drilled deeper and longer, with multiple frac stages, water storage is increasingly becoming problematic.

For some long reach horizontal wells, upwards of 100,000 m3 of water may be required. At least 2 separate reservoirs are required, one for supply water and another for flowback water which may contain hydrocarbons. To store that much onsite water, in ground pits, modular tanks or frac ponds are typically used.

In ground pits pose problems due to the costs associated with the civil work and liners required. It also poses a challenge from a reclamation perspective as the ground needs to be reclaimed back to its original state when finished.

Modular single load tanks are another method to store water however because water storage requirements are increasing, the number of individual tanks cause multiple issues. Both from a cost and physical footprint on location perspective.

Frac ponds are becoming the most common method to store water. A frac pond consists of individual wall panels which are curved to facilitate a round tank. These panels are typically bolted or pinned together. A geomembrane is then installed onto the ground and a separate liner is then used inside the tank which extends over the tank top to facilitate full containment. Depending on the volume, secondary containment may be required outside the tank which is typically a berm. Regulations regarding the construction and installation are typically governed. The wall panels are simply used to provide support for the liner. The wall panels are not designed to be water tight. After the wellbore has been completed, the frac pond wall panels and liner can be disassembled and re-used on another location. The size of the frac ponds can vary but conventionally, the largest pond currently being used holds ~12,000 m3. This size of tank consists of 19 individual panels which form a pond measuring 210 ft diameter×12 ft tall. Due to transport regulations and because they are designed to facilitate easy and cost-effective installation, designing simply a bigger tank is not desirable.

SUMMARY OF THE INVENTION

According to one aspect of the invention there is provided a modular storage tank comprising:

a plurality of rigid floor panels which are joined to one another to form a continuous floor;

a plurality of rigid, upright wall panels joined to one another to form a continuous perimeter wall extending upwardly from the continuous floor;

the floor panels and the wall panels being joined to one another in sealed relationship such that the continuous floor and the continuous perimeter wall form a vessel suitable for containing liquid therein; and a continuous, flexible liner membrane supported within the vessel to span over the continuous floor and an inner surface of the continuous perimeter wall such that the liner membrane defines a primary containment receptacle suitable for containing liquid therein and such that the vessel formed by the floor panels and the wall panels defines a secondary containment receptacle suitable for containing liquid therein in the event of a leak in the primary containment receptacle.

A very large volume tanks which is still modular and re-useable provides many different benefits in the market today. A reduction in footprint, integrated secondary containment and an asset which can be re-used equates to a lower cost to the customer.

Preferably the floor panels are joined to one another to form the continuous floor by welded seams, and the continuous floor is joined to the continuous perimeter wall by a welded seam.

The wall panels are preferably joined to one another for forming the continuous perimeter wall using threaded fasteners such that the wall panels are readily separable from one another. In the illustrated embodiment, a junction between each adjacent pair of wall panels is secured using a plurality of rows of fasteners at different elevations along a height of the wall panels in which at least some of the rows adjacent to a top end of the wall panels have fewer fasteners therein than at least some of the rows adjacent a bottom end of the wall panels.

Preferably a resilient gasket member is received between each adjacent pair of the wall panels that are joined by threaded fasteners to form a sealed connection therebetween.

Preferably at least some of the wall panels include an upright wall portion forming part of the continuous perimeter wall and a base flange portion joined in sealed relationship along a bottom end of the upright wall portion transversely to the upright wall portion, in which both the upright wall portion and the base flange portion are joined to the corresponding upright portion and the corresponding base flange portion of an adjacent wall panel using threaded fasteners.

The base flange portions are preferably joined to the continuous floor using a welded connection. When each base flange portion comprises an inner flange portion protruding inwardly from the upright wall portion and an outer flange portion protruding outwardly from the upright wall portion, preferably the inner flange portions are joined to the continuous floor by the welded connection.

The outer flange portion of each wall panel may form a threaded connection to an adjacent one of the wall panels.

A plurality of gussets may be formed between the outer flange portion and the upright wall portion of each wall panel.

Preferably each wall panel includes a resilient gasket received (i) between the upright wall portion of the wall panel and an adjacent wall panel and (ii) between the base flange portion and the adjacent wall panel.

Each wall panel in the illustrated embodiment comprises (i) a rigid sheet spanning an inner side of the wall panel, (ii)

a plurality of reinforcing posts extending in an upright orientation along an outer side of the rigid sheet, and (iii) a top beam extending along the outer side of the rigid sheet adjacent the top end of the rigid sheet.

Each wall panel may further define a mounting portion at a first end of the rigid sheet and a mounting flange protruding in a longitudinal direction of the rigid sheet beyond one of the reinforcing posts adjacent a second end of the rigid sheet which forms an overlapping fastened connection with the mounting portion at the first end of an adjacent one of the wall panels.

The top beams of adjacent wall panels are preferably joined by threaded fasteners.

Each wall panel may further include a plurality of stiffening flanges extending along the outer side of the rigid sheet across a full length of the rigid sheet of the wall panel between the ends of the rigid sheet at different elevations along the rigid sheet.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
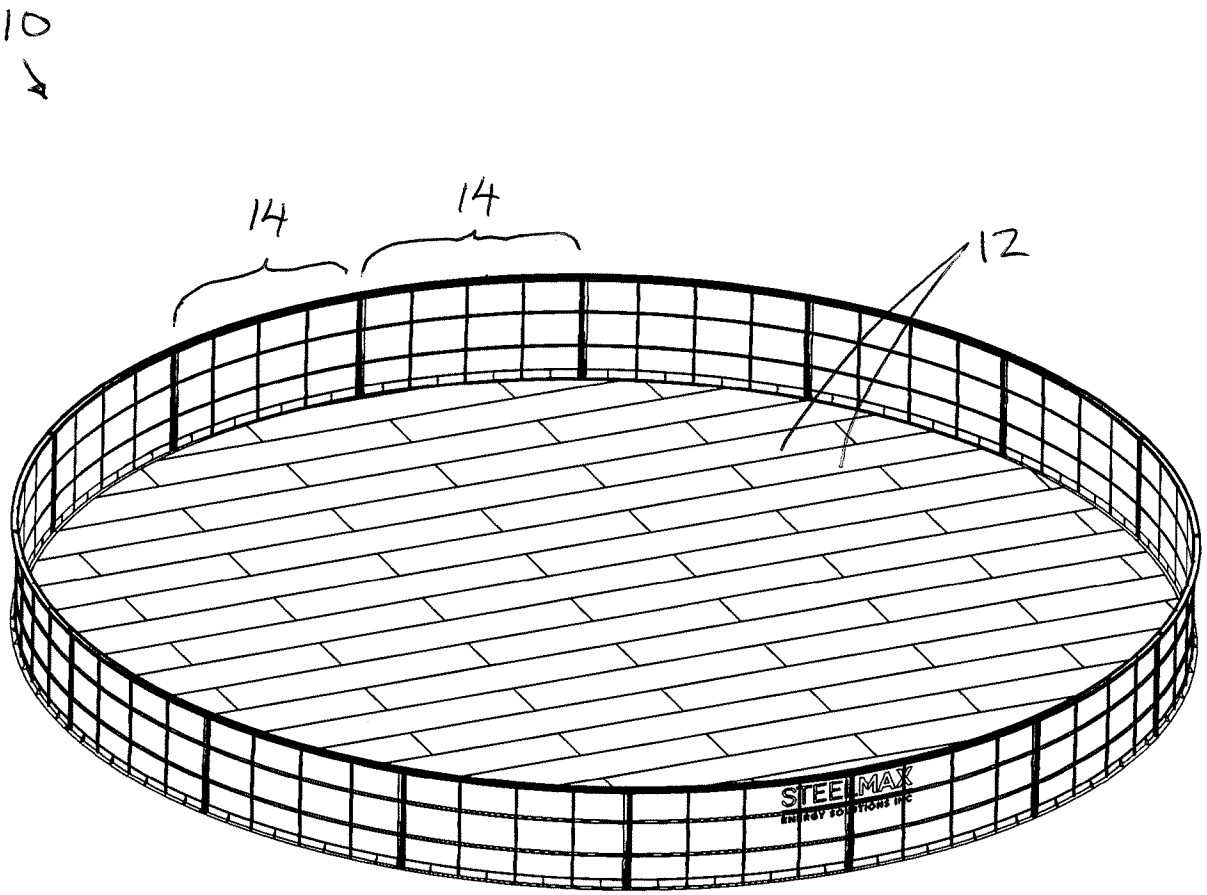
FIG. 1 is perspective view of the assembled modular storage tank.
Figure 2:
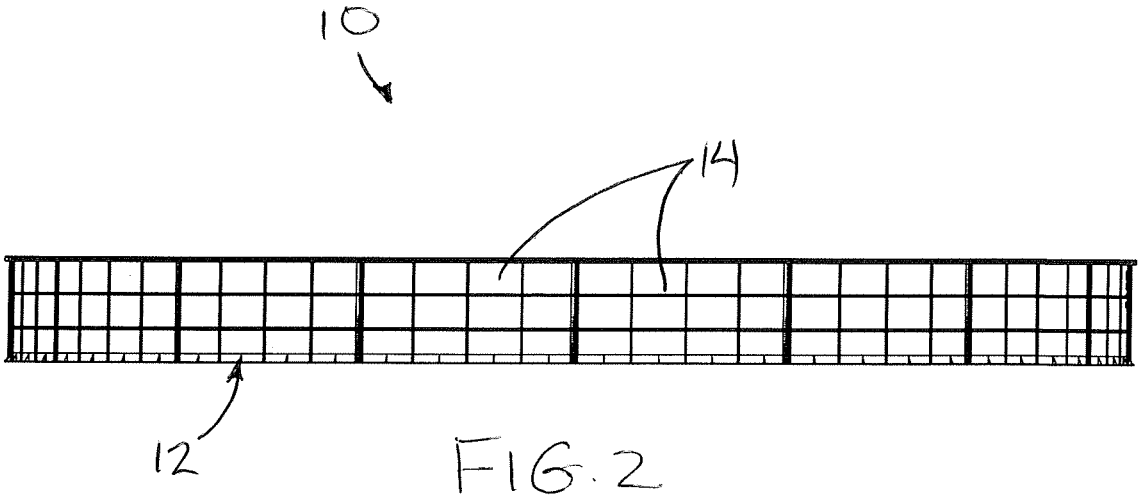
FIG. 2 is a side elevational view of the assembled modular storage tank.
Figure 3:
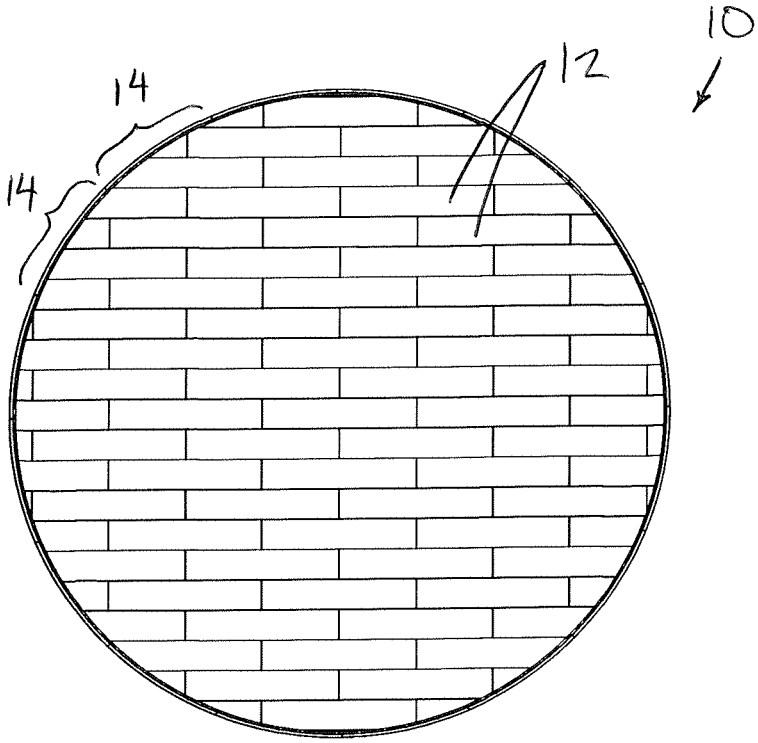
FIG. 3 is a top plan view of the assembled modular storage tank.

Referring to the accompanying figures, there is illustrated a modular storage tank generally indicated by reference numeral 10. The modular storage tank 10 is suited for the storage and containment of large volumes of liquids used in the oil and gas industry to perform various wellbore operations, including fracing for example.

The modular storage tank 10 generally includes a plurality of rigid floor panels 12 that are assembled together to form a continuous floor that defines a bottom boundary of a liquid containment vessel, and a plurality of upright wall panels 14 that are assembled together to form a continuous perimeter wall which is cylindrical in shape and which extends upwardly about a perimeter of the generally circular continuous floor to defines a perimeter boundary of the liquid containment vessel.

The tank 10 further includes a liner membrane 16 which is formed of a flexible waterproof material including a floor portion that is generally circular to span over the continuous floor of the containment vessel and a wall portion that is generally cylindrical to span an inner surface of the perimeter wall of the containment vessel. The liner membrane 16 forms a continuous waterproof layer lining the interior of the containment vessel to act as a primary containment receptacle suitable for containing liquid therein, while the vessel formed by the floor panels 12 and the wall panels 14 defines a secondary containment receptacle suitable for containing liquid therein in the event of a leak or failure in the primary containment receptacle.

The floor panels each comprise a rectangular plate formed of rigid sheet metal in the illustrated embodiment; however, in further embodiments the plates forming the floor panels may assume a variety of shapes provided that the individual panels can be joined to one another to form a continuous floor which is free of any gaps such that the resulting assembled floor is continuous and waterproof for containing liquids. The individual floor panels are assembled by abutting the edges of the panels together so that the panels lie in a common plane over flat ground. The edges of the floor panels 12 are welded to adjacent panels about the full perimeter thereof in forming the continuous floor once assembled. Typically, the ground is prepared before installation of the tank thereon by leveling and/or use of a base material such as a layer of crushed stone or the like to provide a suitable foundation for supporting the tank thereon.

The wall panels 14 each extend in a generally longitudinal direction between opposing ends 18 of the panel in which the longitudinal direction of the wall panels corresponds to the circumferential direction of the assembled tank. Each wall panel forms a respective modular section of the upright, continuous perimeter wall formed by the wall panels. Each panel spans a full height of the assembled perimeter wall but extends only partway about a circumference of the cylindrical wall. Each wall panel 14 generally includes an upright wall portion 20 and a base flange portion 22 joined in perpendicular relation to the upright wall portion 20 at the bottom end thereof. The base flange portion 22 is used for connection of the wall panel to the continuous floor of the tank as described in further detail below.

The upright wall portion 20 of each modular wall panel generally includes a rigid sheet 24 spanning the inner side of the upright wall portion, a plurality of reinforcing posts 26 extending vertically along an outer side of the upright wall portion, and a plurality of stiffener members 28 extending horizontally between the reinforcing posts 26 also at the rear side of the upright wall portion to assist in reinforcing the rigid sheet 24.

The rigid sheet 24 is typically assembled from a plurality of smaller sheets which are abutted at their respective edges with adjacent sheets and which are welded together to form a continuous rigid sheet 24 spanning longitudinally approximately the full length of the respective wall panel between the opposing ends 18 of the wall panel, and spanning the full height of the wall panel between the base flange portion at the bottom and the opposing top end defining the top end of the assembled tank structure. The rigid sheet 24 of each wall panel 14 defines a respective portion of the inner surface of the continuous perimeter wall of the assembled tank structure.

The reinforcing posts 26 comprise tubular metal posts, each spanning the full height of the rigid sheet at longitudinally spaced positions relative to other posts between the opposing ends of the wall panel. The posts 26 are joined, for example by welding, to the rear side of the rigid sheet 24 of the respective wall panel.

The stiffener members 28 comprise ribs or horizontal flanges joined at the inner edge thereof, for example by welding, to the rear surface of the rigid sheet to extend generally radially outward therefrom at a plurality of different elevations along the height of the rigid sheet 24. The stiffener members 28 are provided in sections in which each section spans between an adjacent pair of the reinforcing post 26 such that a set of stiffener member sections at a common elevation collectively span the full length of the rigid sheet between the opposing ends 18 of the wall panel.

Each wall panel further includes a top beam 30 joined to the rear side of the rigid sheet 24 along the top edge thereof to extend substantially the full length of the wall panel between the opposing ends 18 of the rigid sheet of the wall panel. In the illustrated embodiment, the top beam may be configured as an I-beam oriented to provide optimal hoop strength to the tank. More particularly the top beam includes (i) an inner flange 32 against the rigid sheet, (ii) an outer flange 34 which is parallel and spaced radially outward from the inner flange so as to also lie parallel to the rigid sheet while following the curve in the circumferential direction of the tank, and (iii) a web 36 extending generally horizontally and radially outward from the inner flange to the outer flange. An end plate 38 is provided at each of the longitudinally opposed ends of the top beam 30 in which the end plate is oriented generally perpendicularly to the circumferential direction of the tank. In the assembled configuration of the tank, the end plate 38 at each end of each top beam is abutted against the corresponding end plate of an adjacent wall panel to enable threaded fasteners to extend through cooperating apertures in the end plates for coupling the top beams longitudinally in series with one another about the full circumference of the assembled tank.

Figure 6:
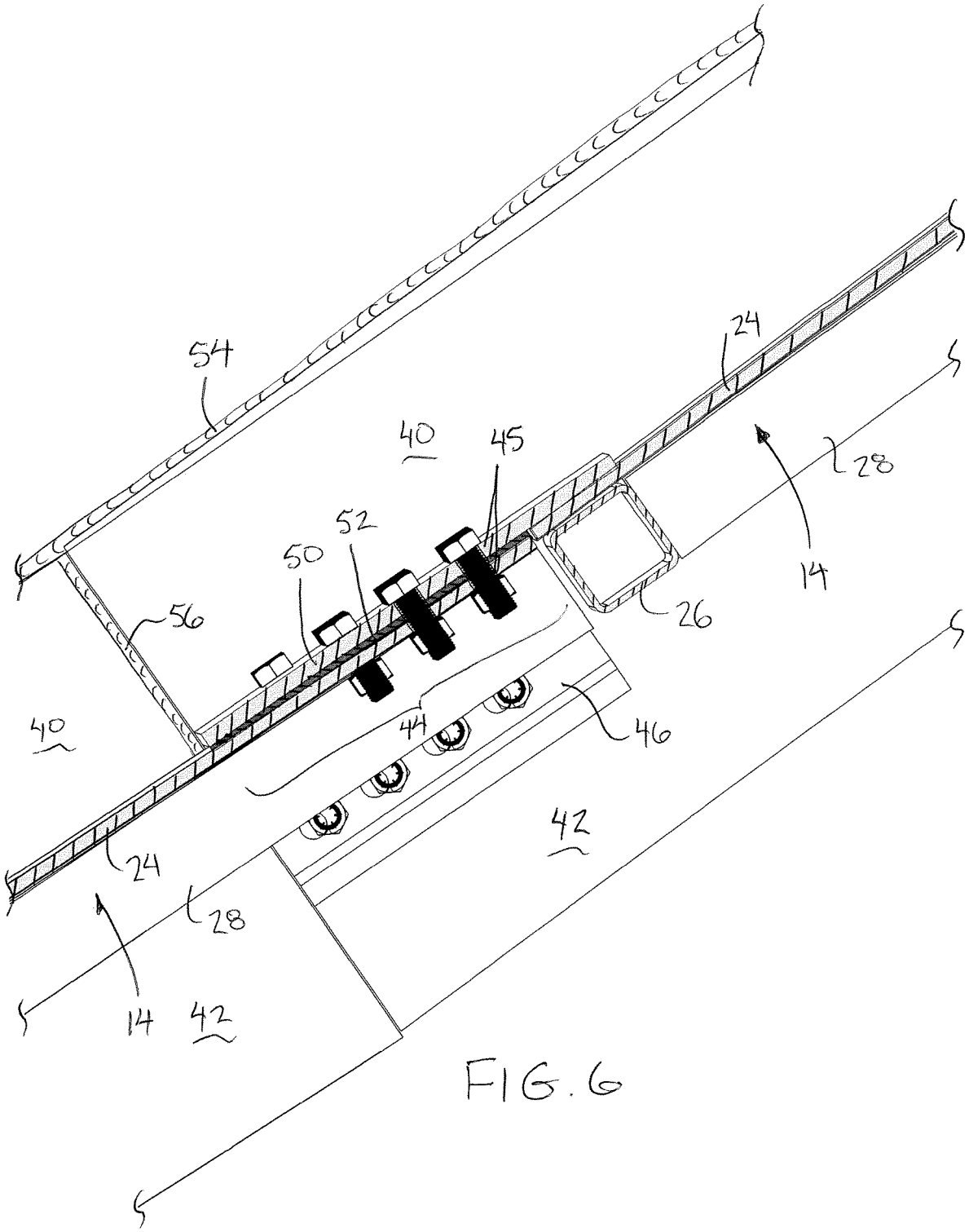
FIG. 6 is sectional view along the line 6-6 in FIG. 4.
Figure 7:
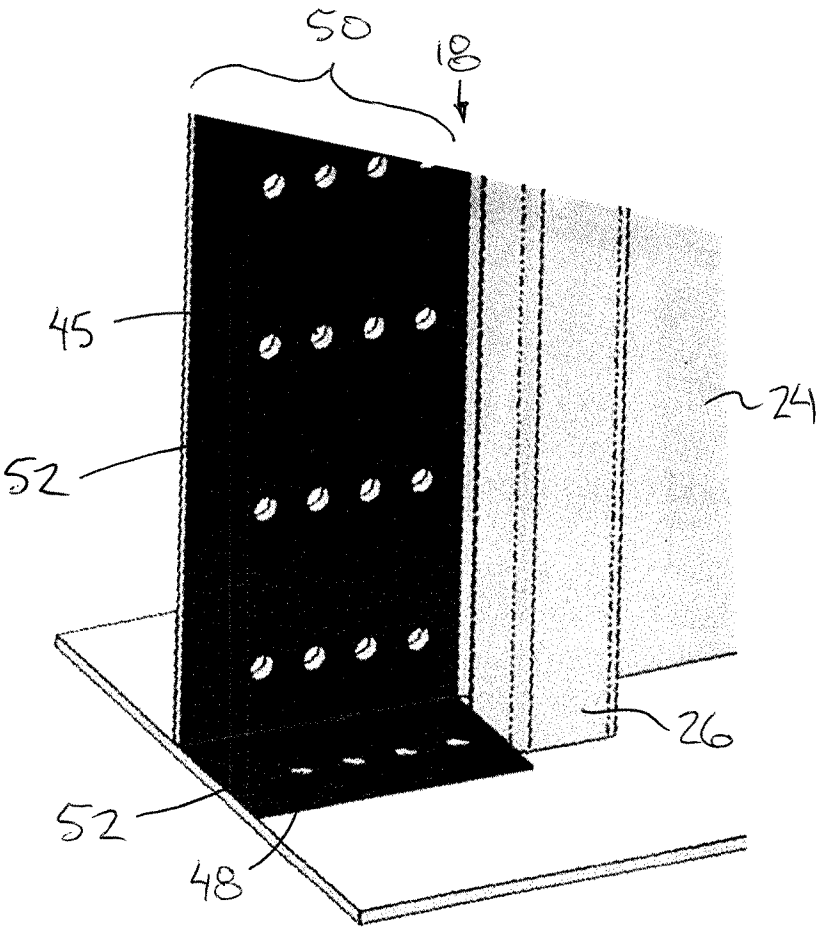
FIG. 7 is an outside view of the first end of one wall panel and a second end of another wall panel prior to connection of the wall panels.
Figure 7:
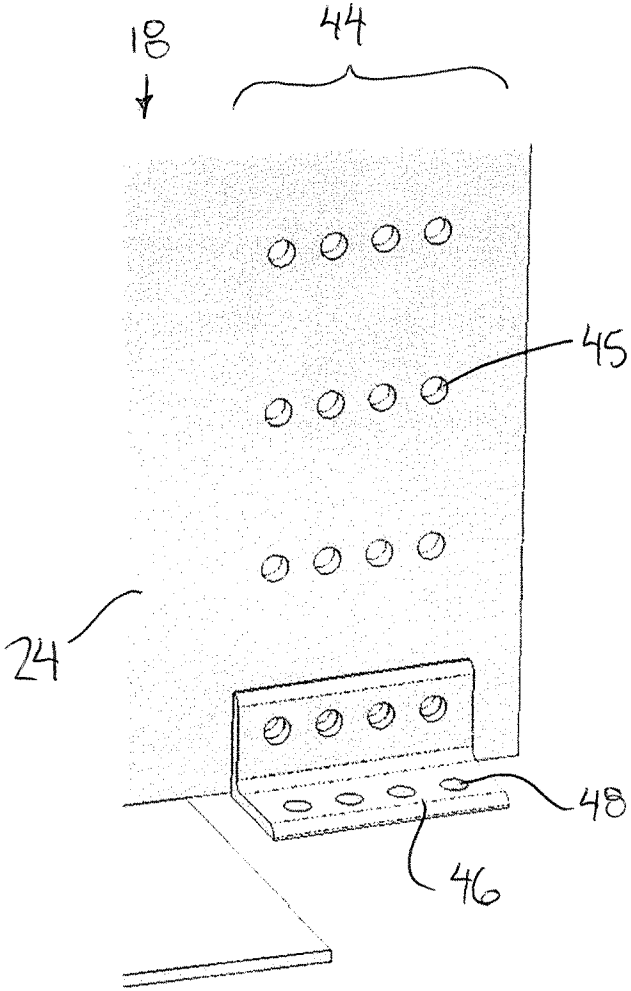
Figure 8:
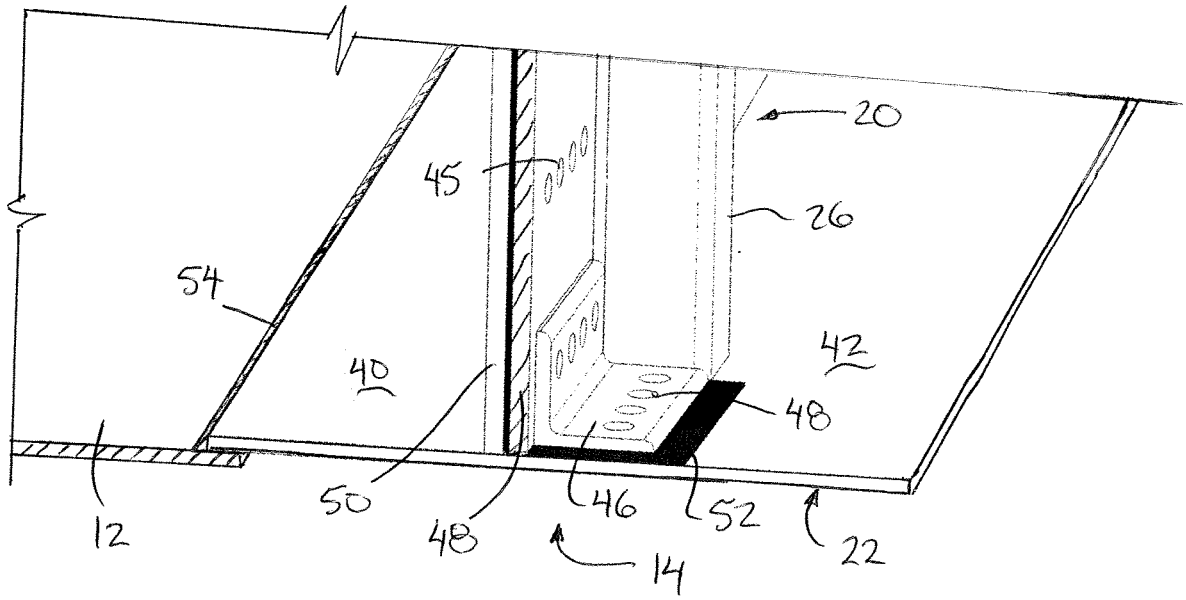
FIG. 8 is a partly sectional view of the second end of the wall panel in fastened connection to the first end of an adjacent panel with a sealing gasket received therebetween.
Figure 9:
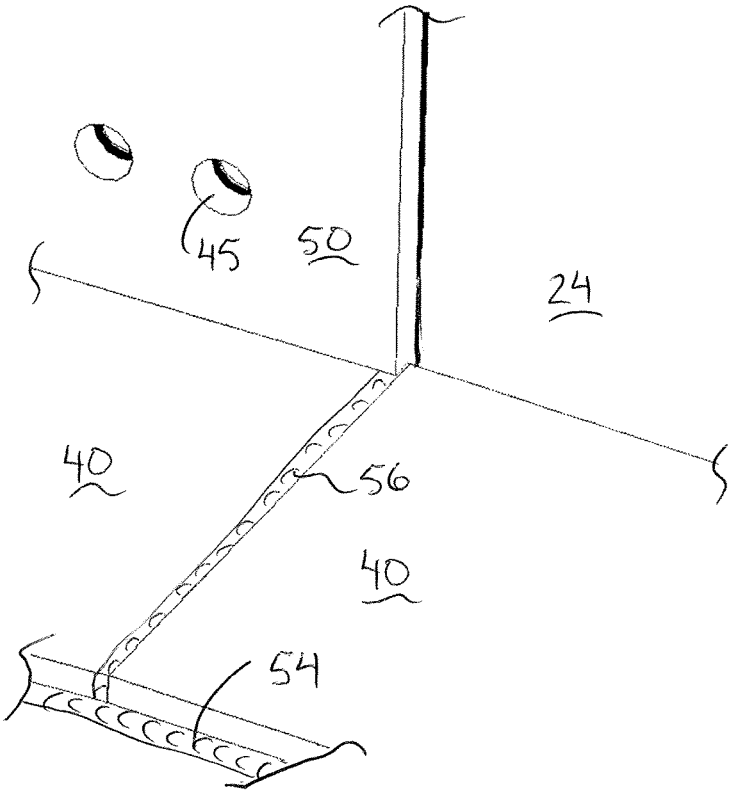
FIG. 9 is an inside view of the junction between two adjacent wall panels illustrating the base flange portions of the wall panels abutted with one another and the first end of the upright wall portion overlapping the second end of the adjacent upright wall portion.
Figure 10:
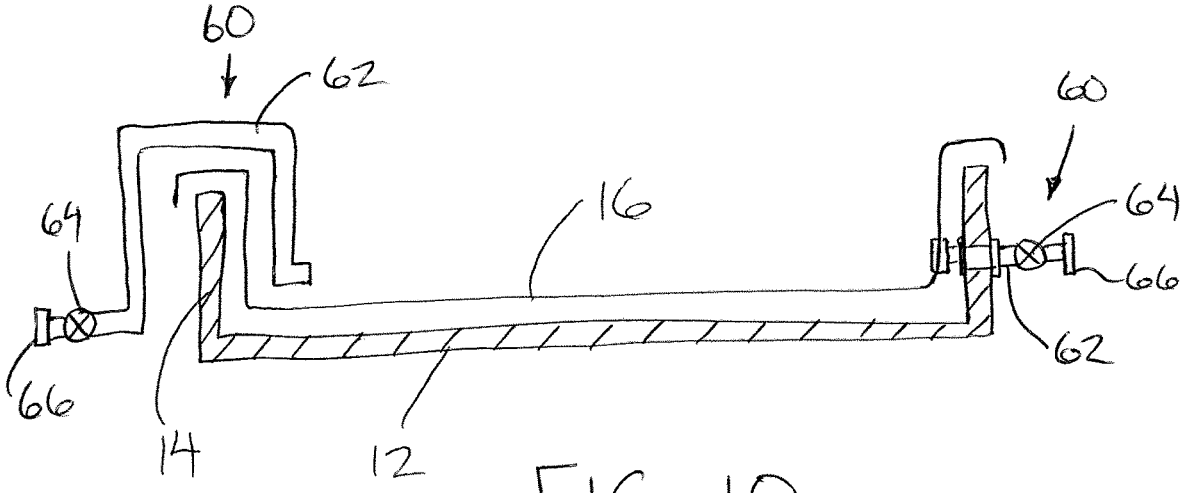
FIG. 10 is a schematic representation of a liner received within the tank such that the wall panels and floor panels act as a secondary containment to fluid retained within an interior of the liner, together with an inlet pipe and an outlet pipe in communication from the interior of the liner to the exterior of the modular storage tank.

The base flange portion 22 of each wall panel is generally centred in the radial direction of the tank relative to the respective rigid sheet 24 such that the base flange portion defines an inner flange portion 40 extending radially inward of the rigid sheet 24 towards the interior of the tank and an outer flange portion 42 protruding generally radially outward from the rigid sheet 24 of the wall panel. A plurality of gussets 43 are joined between the outer flange portion 42 and the exterior side of the rigid sheet 24 to provide additional reinforcement to the rigid sheet by the base flange portion. The base flange portion is longitudinally offsite in relation to the rigid sheet such that the rigid sheet protrudes beyond the end of the base flange portion 22 at a first end of the wall panel by a prescribed distance in the circumferential direction of the tank. Similarly, the base flange portion 22 protrudes beyond the end of the rigid sheet 24 at an opposing second end of the wall panel by the same prescribed distance in the circumferential direction of the tank is best shown in FIG. 6.

Figure 4:
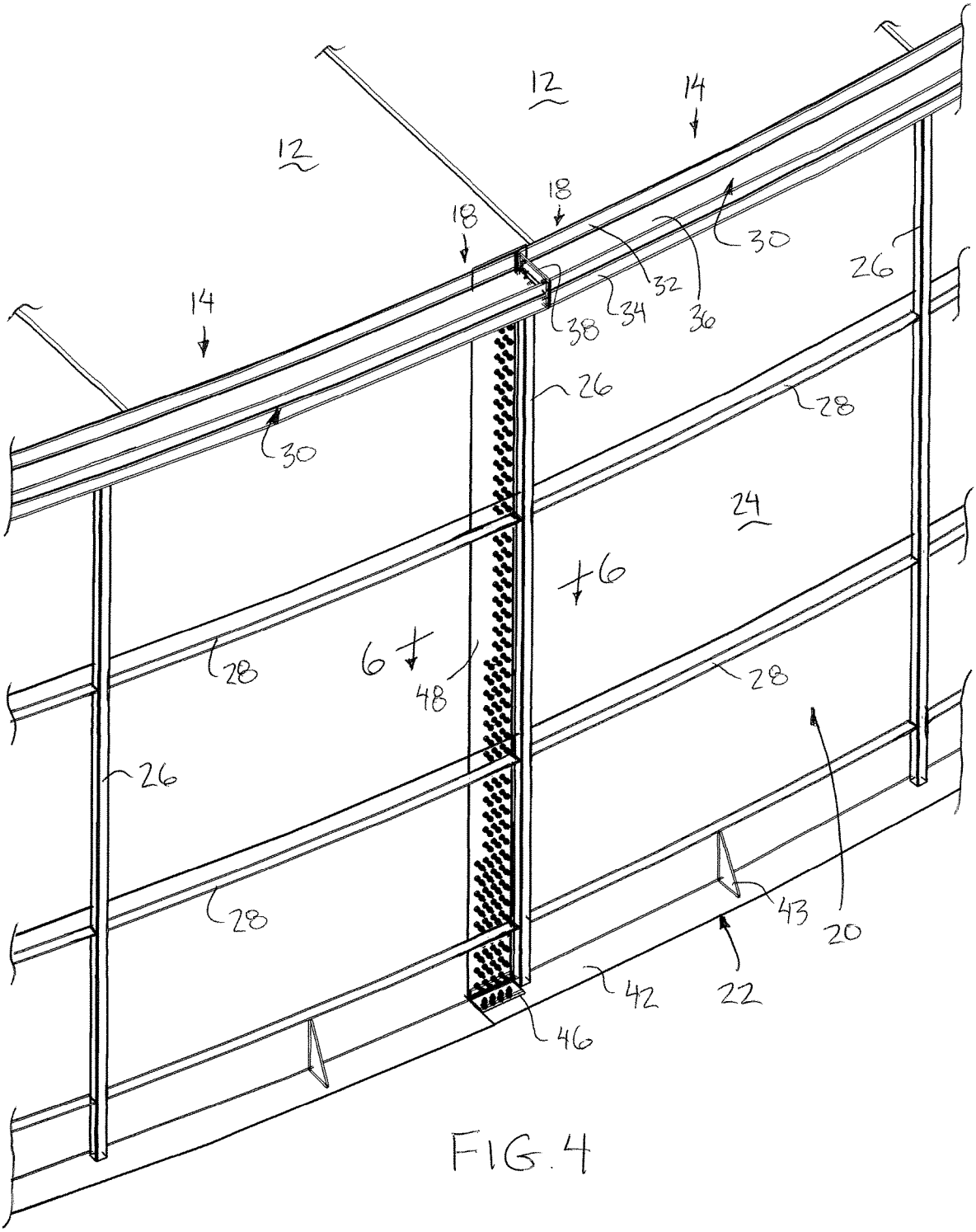
FIG. 4 is a perspective view of a fastened connection between an adjacent pair of the wall panels showing an outer side of the panels.
Figure 5:
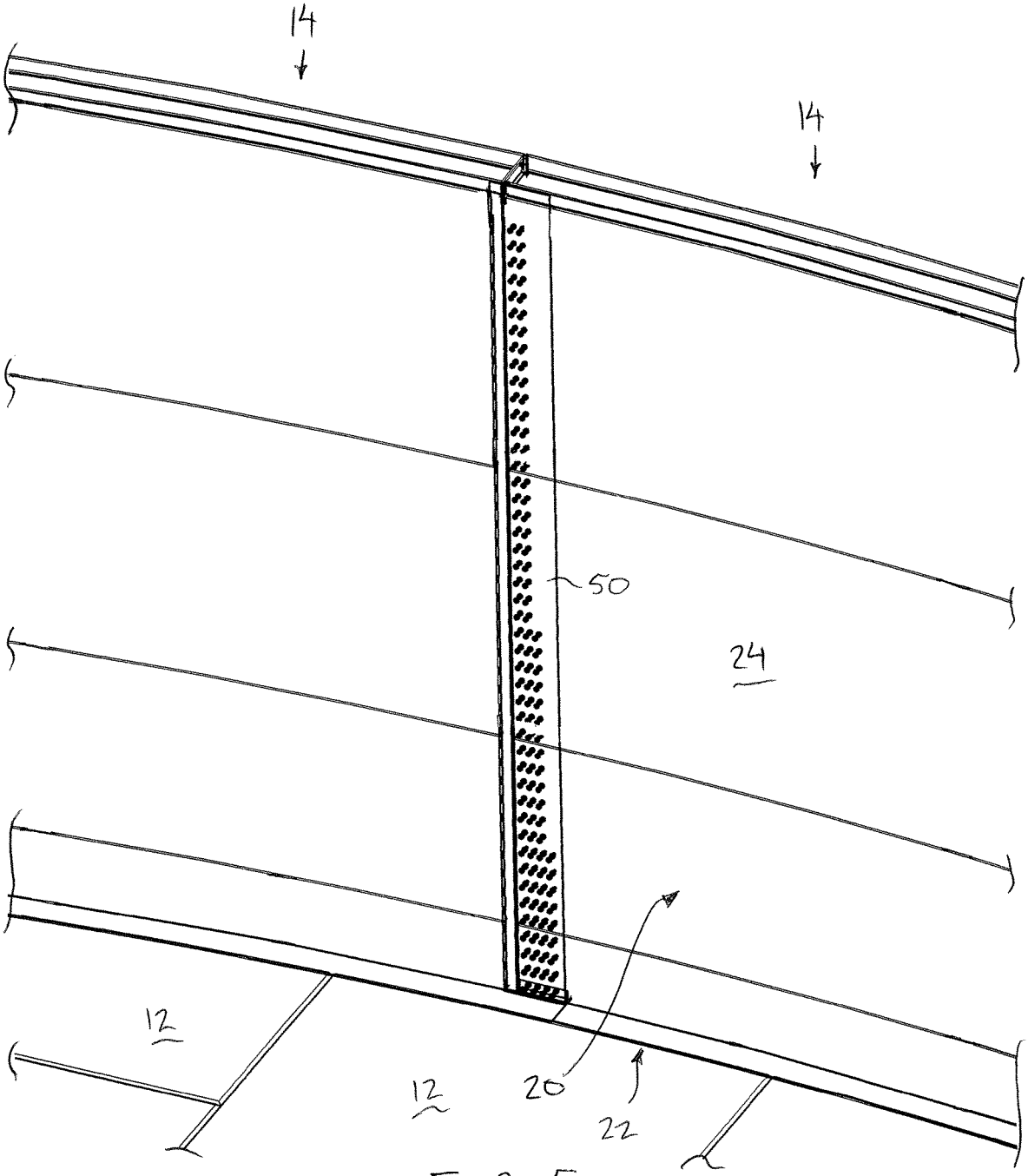
FIG. 5 is a perspective view of a fastened connection between an adjacent pair of the wall panels showing an inner side of the panels.

At the first end of the wall panel, the end portion of the rigid sheet which protrudes longitudinally outward beyond the end of the base flange portion defines a mounting portion 44 used for forming a mechanical connection to an adjacent wall panel in the assembled tank. The mounting portion 44 thus includes a plurality of horizontal rows of fastener apertures 45 in which the rows are vertically spaced apart along the full height of the mounting portion 44. A greater number of faster apertures are provided in the rows of fasteners adjacent the bottom of the wall panel, whereas rows of fasteners adjacent to the top of the wall panel have fewer apertures per row is best shown in FIGS. 4 and 5. This provides greater hoop strength to the mechanical connection between adjacent wall panels adjacent the bottom of the tank as compared to the top of the tank to accommodate for greater pressure exerted on the bottom portion of the walls as compared to the upper portion of the walls when containing fluids within the tank.

Also at the first end of the wall panel, a bottom flange 46 is provided at the bottom end of the mounting portion 44 to protrude perpendicularly outward from the bottom edge of the mounting portion 44. The bottom flange is positioned such that the bottom surface of the bottom flange 46 lies in a common plane with a top surface of the adjacent base flange portion. In this manner, when two adjacent wall panels are joined together, the bottom surface of the bottom flange 46 is directly adjacent the upper surface of the protruding end portion of the base flange portion of an adjacent wall panel. Cooperating apertures 48 are provided in the bottom flange 46 at the first end of the wall panel and in the base flange portion at the second end of the adjacent wall panel to allow threaded fasteners to be coupled through the cooperating apertures for joining the adjacent wall panels.

At the second end of the wall panel, one of the reinforcing posts 26 is provided at the second end of the rigid sheet 24 at a location spaced inward from the end of the wall panel by the same prescribed distance defining the width of the mounting portion 44 noted above. An additional mounting flange 50 is joined at the inner surface of the rigid sheet 24 at the second end thereof to span the full height of the rigid sheet and to extend longitudinally outward beyond the end of the sheet by the prescribed distance of the mounting portion 44.

In this manner, when the rigid sheets 24 of two adjacent wall panels are directly abutted with one another, the mounting flange 50 at the second end of one of the wall panels overlaps directly against the inner surface of the mounting portion 44 at the first end of the rigid sheet of the adjacent wall panel along the full height of the wall panels. The same configuration of fastener apertures 45 according to the mounting portion 44 at the first end of the wall panel is provided in the mounting flange 50 at the second end of the wall panel to accept threaded fasteners coupling the mounting flange 50 to the mounting portion 44 at each aligned set of apertures 45 at each junction between two adjacent wall panels.

The mounting flange 50 extends longitudinally beyond the second end of the rigid sheet 24 by the same distance as the longitudinal offset of the base flange portion such that the end of the base flange portion and the outer edge of the mounting flange 50 terminate in a common vertical plane at the second end of the wall panel. The mounting flange 50 is offset radially inwardly relative to the rigid sheet by the thickness of the rigid sheet to enable the rigid sheets 24 of two adjacent wall panels to abut one another while the mounting flange 50 overlaps the inner surface of the rigid sheet of the adjacent wall panel and while the corresponding base flange portions abut one another.

A gasket 52 formed of resilient material is received between the overlapping portions of two adjacent wall panels at each junction of two wall panels to assist in forming a watertight seal. The layer of resilient gasket material fully spans the exterior side of the mounting flange 50 such that the gasket 52 fully spans the inner surface of the mounting portion 44 of an adjacent wall panel when the wall panels are joined together. The gasket 52 also spans continuously from the mounting flange 50 to an upper surface of the outer flange portion 42 directly therebelow which is overlapped by the bottom flange 46 of an adjacent wall panel in the assembled configuration. The gasket 52 includes suitable apertures therein in alignment with the fastener apertures 45 and 48 of the wall panels to accept the threaded fasteners penetrated therethrough in the assembled configuration.

To form a connection between the upright wall panels and the floor panels 12 forming the continuous floor of the assembled tank, a weld bead 54 is provided along the inner edge of the base flange portions about the full perimeter of the tank for joining the inner edge of the base flange portions to the continuous floor that is overlapped by the inner flange portion of the base flange portions. An additional weld bead 56 is provided at the abutted junction between the inner flange portions 40 at the junction of each adjacent pair of wall panels. Each weld bead 56 joins from the weld bead 54 to the rigid sheets of the corresponding wall panels at the bottom of the gasket 52 between the adjacent wall panels. This forms a complete sealed interface between adjacent wall panels and between the wall panels and the floor to form a complete receptacle for containing liquids therein as a secondary containment as described above.

In order to provide access to the interior of the storage tank for introducing liquids into the tank or withdrawing liquids from the tank, inlet and outlet ports 60 are provided for communication between the interior and the exterior of the tank walls.

In one embodiment, both of the inlet and outlet ports 60 comprise tubular piping 62 communicating through the rigid wall of the upright wall panels 14 and through the wall portion of the liner therein by forming sealed gasketed junctions through each of the walls while permitting flow of fluid through the piping 62 from the interior of the tank to the exterior of the tank. A shut off valve 64 is typically connected in series with the piping 62 at the exterior of the tank for controlling flow through the piping. A pipe flange 66 is provided in the piping 62 at the exterior thereof for connection to other suitable equipment.

In further embodiments, one or both of the inlet and outlet ports 60 may comprise piping 68 extending over both the rigid perimeter wall of the tank and the wall portion of the liner 16 received within the tank to communicate from an inner end of the piping located within the interior of the tank and an outer end of the piping located externally of the tank. Again, a shut off valve 64 is provided in series with the piping and a pipe flange 66 is provided at the exterior end of the piping for connection to other related equipment. This configuration may be desirable where it is preferred that the primary and secondary containment vessels remain uninterrupted.

In use, the ground is typically prepared to receive the tank supported thereon in the usual manner. The floor panels 12 are then welded together to form the continuous floor. The wall panels 14 are delivered as modular sections to the site requiring only assembly of the wall panels 14 to one another using the fastened connections described above together with welded connection of the inner flange portions 40 of the wall panels to one another and to the continuous floor formed of floor panels 12 that are overlapped at the perimeter edge thereof by the inner flange portions 40 of the wall panels. The liner 16 is then placed within the tank with the top edge of the liner being secured to the top edge of the tank walls about the full perimeter of the tank. Accommodations are made for providing inlet and outlet ports as desired.

When use of the modular storage tank 10 is no longer required, the weld beads 54 and 56 are cut and the threaded fasteners at the junction of each adjacent pair wall panels are removed such that the wall panels can be separated from one another and transported to another site for reuse. The floor panels can also be cut apart and scrapped or reused as may be desired.

As described herein, the present invention provides a tank which has the following characteristics: (i) 35,000 m3 overall water storage (single tank); (ii) panel heights not to exceed 24 ft; (iii) integral 30 mm standard liner; (iv) water tight wall panels to facilitate secondary containment; and (v) integrated water tight floor panels.

The tank when assembled is 255 ft in diameter, 24 ft tall and consists of 16 wall panels. Each panel is constructed with a heavy upper beam, intermediate stiffener rings, and a floor plate. Each wall panel is bolted together with a gasket to provide a water tight connection point.

The floor will be constructed using 3/16" standard plate. Each seam will be seal welded in place. The perimeter plates will be cut to suit, and seal welded to the bottom floor plate found on each wall panel. The floor may be laid out in a wedge pattern or rectangular panel.

With use of the floor panels which are seal welded and wall panels, the tank structure forms a water tight seal used for secondary containment. A liner is installed inside the tank which is used for primary containment.

With this design, the tank can be disassembled as re-used on another location. The floor to wall seam will need to be cut apart and each wall panel unbolted but can be re-used. A new floor plate will be required at the new site.

In summary, the modular storage tank is assembled from a plurality of rigid floor panels which are joined to one another to form a continuous floor and a plurality of rigid, upright wall panels joined to one another to form a continuous perimeter wall extending upwardly from the continuous floor. The floor panels and the wall panels are joined to one another in sealed relationship such that the continuous floor and the continuous perimeter wall form a vessel suitable for containing liquid therein.

A continuous, flexible, liner membrane supported within the vessel to span over the continuous floor and an inner surface of the continuous perimeter wall. In this manner, the liner membrane defines a primary containment receptacle suitable for containing liquid therein, while the vessel formed by the floor panels and the wall panels defines a secondary containment receptacle suitable for containing liquid therein in the event of a leak in the primary containment receptacle.

The floor panels are joined to one another to form the continuous floor by welded seams. Similarly, the continuous floor is joined to the continuous perimeter wall by a welded seam.

The wall panels are joined to one another for form the continuous perimeter wall using threaded fasteners such that the wall panels are readily separable from one another. A resilient gasket member is received between each adjacent pair of the wall panels that are joined by threaded fasteners to form a sealed connection therebetween.

The wall panels along the bottom of the perimeter wall each include an upright wall portion forming part of the continuous perimeter wall and a base flange portion joined in sealed relationship along a bottom end of the upright wall portion transversely to the upright wall portion. Typically, both the upright wall portion and the base flange portion are joined to the corresponding upright portion and the corresponding base flange portion of an adjacent wall panel using threaded fasteners. The base flange portions are joined to the continuous floor using a welded connection. The resilient gasket is received both between the upright wall portions and between the base flange portions of each adjacent pair of the wall panels that are joined using threaded fasteners.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A modular storage tank comprising:

a plurality of rigid floor panels which are joined to one another to form a continuous floor;

a plurality of rigid, upright wall panels joined to one another to form a continuous perimeter wall extending upwardly from the continuous floor;

the floor panels and the wall panels being joined to one another in sealed relationship such that the continuous floor and the continuous perimeter wall form a vessel suitable for containing liquid therein; and a continuous, flexible liner membrane supported within the vessel to span over the continuous floor and an inner surface of the continuous perimeter wall such that the liner membrane defines a primary containment receptacle suitable for containing liquid therein and such that the vessel formed by the floor panels and the wall panels defines a secondary containment receptacle suitable for containing liquid therein in the event of a leak in the primary containment receptacle.

2. The tank according to claim 1 wherein the floor panels are joined to one another to form the continuous floor by welded seams.

3. The tank according to claim 1 wherein the continuous floor is joined to the continuous perimeter wall by a welded seam.

4. The tank according to claim 1 wherein the wall panels are joined to one another for forming the continuous perimeter wall using threaded fasteners such that the wall panels are readily separable from one another.

5. The tank according to claim 4 wherein a junction between each adjacent pair of wall panels is secured using a plurality of rows of fasteners at different elevations along a height of the wall panels and wherein at least some of the rows adjacent to a top end of the wall panels have fewer fasteners therein than at least some of the rows adjacent a bottom end of the wall panels.

6. The tank according to claim 4 further comprising a resilient gasket member received between each adjacent pair of the wall panels that are joined by threaded fasteners to form a sealed connection therebetween.

7. The tank according to claim 1 wherein at least some of the wall panels include an upright wall portion forming part of the continuous perimeter wall and a base flange portion joined in sealed relationship along a bottom end of the upright wall portion transversely to the upright wall portion, and wherein both the upright wall portion and the base flange portion are joined to the corresponding upright portion and the corresponding base flange portion of an adjacent wall panel using threaded fasteners.

8. The tank according to claim 7 wherein the base flange portions are joined to the continuous floor using a welded connection.

9. The tank according to claim 8 wherein each base flange portion comprises an inner flange portion protruding inwardly from the upright wall portion and an outer flange portion protruding outwardly from the upright wall portion, wherein the inner flange portions are joined to the continuous floor by the welded connection.

10. The tank according to claim 9 wherein the outer flange portion of each wall panel forms a threaded connection to an adjacent one of the wall panels.

11. The tank according to claim 9 further comprising a plurality of gussets formed between the outer flange portion and the upright wall portion of each wall panel.

12. The tank according to claim 7 wherein each wall panel includes a resilient gasket received (i) between the upright wall portion of the wall panel and an adjacent wall panel and (ii) between the base flange portion and the adjacent wall panel.

13. The tank according to claim 1 wherein each wall panel comprises a rigid sheet spanning an inner side of the wall panel, a plurality of reinforcing posts extending in an upright orientation along an outer side of the rigid sheet, and a top beam extending along the outer side of the rigid sheet adjacent the top end of the rigid sheet.

14. The tank according to claim 13 wherein each wall panel defines a mounting portion at a first end of the rigid sheet and a mounting flange protruding in a longitudinal direction of the rigid sheet beyond one of the reinforcing posts adjacent a second end of the rigid sheet which forms an overlapping fastened connection with the mounting portion at the first end of an adjacent one of the wall panels.

15. The tank according to claim 13 wherein the top beams of adjacent wall panels are joined by threaded fasteners.

16. The tank according to claim 13 wherein each wall panel further includes a plurality of stiffening flanges extending along the outer side of the rigid sheet across a full length of the rigid sheet of the wall panel between the ends of the rigid sheet at different elevations along the rigid sheet.

* * * * *